US006368495B1

(12) United States Patent
Kocal et al.

(10) Patent No.: US 6,368,495 B1
(45) Date of Patent: Apr. 9, 2002

(54) REMOVAL OF SULFUR-CONTAINING COMPOUNDS FROM LIQUID HYDROCARBON STREAMS

(75) Inventors: Joseph A. Kocal, Glenview; Timothy A. Brandvold, Arlington Heights, both of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/689,550

(22) Filed: Oct. 12, 2000

Related U.S. Application Data

(63) Continuation-in-part of application No. 09/327,362, filed on Jun. 7, 1999, now abandoned.

(51) Int. Cl.[7] ..... C10G 29/22

(52) U.S. Cl. ..... 208/240; 208/243; 208/244; 208/249; 208/88

(58) Field of Search ..... 208/208 R, 243, 208/244, 249, 88, 240

(56) References Cited

U.S. PATENT DOCUMENTS 2,671,049 A * 3/1954 Brown ..... 208/189
3,595,778 A * 7/1971 Smetana et al. ..... 208/208 R
3,719,589 A * 3/1973 Herbstman et al. ..... 208/208 R
3,816,301 A * 6/1974 Sorgenti ..... 208/208 R
3,847,800 A * 11/1974 Guth et al. ..... 208/236
3,945,914 A * 3/1976 Yoo et al. ..... 208/208 R
4,875,997 A * 10/1989 Langford ..... 208/235
5,169,516 A * 12/1992 Carr ..... 208/189
5,320,742 A * 6/1994 Fletcher et al. ..... 208/89
5,958,224 A * 9/1999 Ho et al. ..... 208/240
5,961,820 A * 10/1999 Jeanblanc et al. ..... 208/231

* cited by examiner

*Primary Examiner*—Nadine Preisch
(74) *Attorney, Agent, or Firm*—John G. Tolomei; Frank S. Molinaro

(57) ABSTRACT

A novel process effective for the removal of organic sulfur compounds from liquid hydrocarbons is disclosed. The process more specifically addresses the removal of thiophenes and thiophene derivatives from a number of petroleum fractions, including gasoline, diesel fuel, and kerosene. In the first step of the process, the liquid hydrocarbon is subjected to oxidation conditions in order to oxidize at least some of the thiophene compounds to sulfones. Then, these sulfones can be catalytically decomposed to hydrocarbons (e.g. hydroxybiphenyl) and volatile sulfur compounds (e.g. sulfur dioxide). The hydrocarbon decomposition products remain in the treated liquid as valuable blending components, while the volatile sulfur compounds are easily separable from the treated liquid using well-known techniques such as flash vaporization or distillation.

20 Claims, No Drawings

REMOVAL OF SULFUR-CONTAINING COMPOUNDS FROM LIQUID HYDROCARBON STREAMS

CROSS-REFERENCE TO RELATED APPLICATIONS

This application is a continuation-in-part of U.S. application Ser. No. 09/327,362 filed on Jun. 7, 1999, now abandoned, which is incorporated by reference.

FIELD OF THE INVENTION

The present invention relates to a novel process for removing organic sulfur compounds (e.g. thiophenes) from liquid hydrocarbon streams. The process comprises subjecting the liquid hydrocarbon stream to oxidation conditions, thereby oxidizing at least a portion of the organic sulfur compounds to oxidized organic sulfur compounds (e.g. sulfones), followed by catalytically decomposing the oxidized organic sulfur compounds to provide a treated hydrocarbon product of reduced sulfur content.

BACKGROUND OF THE INVENTION

Sulfur is present in a wide range of mostly organic forms in both straight run and refined hydrocarbon streams, including, for example, gasoline, diesel fuel, and kerosene. Sulfur contaminants, while ubiquitous in hydrocarbon products, are suspected of causing adverse environmental effects when converted to sulfur oxides ($SO_x$) upon combustion. $SO_x$ emissions are believed to contribute to not only acid rain, but also to reduced efficiency of catalytic converters designed to improve motor vehicle exhaust quality. Furthermore, sulfur compounds are thought to ultimately increase the particulate content of combustion products. Because of these issues, the reduction of the sulfur content in hydrocarbon streams has become a major objective of recent environmental legislation worldwide. For instance, Canada, Japan, and the European Commission have all recently adopted a 0.05 wt-% limit on diesel fuel sulfur.

For the oil refiner, complying with such increasingly stringent specifications has primarily meant using more severe hydrotreating conditions. Hydrotreating refers to a well-known process whereby hydrogen is contacted with a hydrocarbon stream and catalyst to effect a number of desirable reactions, including the conversion of sulfur compounds to hydrogen sulfide. This reaction product is then separated into a gaseous hydrotreater effluent stream and thus effectively removed from the hydrocarbon product. Hydrotreating can readily reduce the level of several common classes of sulfur compounds such as sulfides, disulfides, and thiols (mercaptans), present in refinery products. Unfortunately, however, hydrotreating (or hydrodesulfurization) often fails to provide a treated product in compliance with the strict sulfur level targets demanded currently. This is due to the presence of sterically hindered sulfur compounds such as unsubstituted and substituted thiophenes that are essentially refractory in hydrotreating environments. Attempts to completely convert these species, which are more prevalent in heavier stocks such as diesel fuel and fuel oil, have resulted in increased equipment costs, more frequent catalyst replacements, degradation of product quality due to side reactions, and continued inability to comply with sulfur specifications.

Several prior art disclosures address sulfur contamination in refinery products. U.S. Pat. No. 2,769,760, for example, describes a hydrodesulfurization process with an additional conversion step that does not further reduce the sulfur level but converts some sulfur species to less-corrosive forms, allowing the product to meet acidity requirements. Other disclosures are more specifically directed toward essentially complete sulfur removal from hydrocarbons. Particularly, the ability to oxidize sulfur compounds that are resistant to the aforementioned hydrogenation method is recognized in a number of cases. Oxidation has been found to be beneficial because oxidized sulfur compounds have an increased propensity for removal by a number of separation processes that rely on the altered chemical properties such as the solubility, volatility, and reactivity of such compounds. Techniques for the removal of oxidized organic sulfur compounds therefore include extraction, distillation, and adsorption.

In U.S. Pat. No. 3,163,593, organic sulfur compounds contained in petroleum fractions are oxidized by contact with a mixture of $H_2O_2$ and a carboxylic acid to produce sulfones, which are then degraded by thermal treatment to volatile sulfur compounds. In U.S. Pat. No. 3,413,307, thiophene and thiophene derivatives are oxidized to sulfones in the presence of a dilute acid. The sulfones are then extracted using a caustic solution. In U.S. Pat. No. 3,341,448, the oxidation and thermal treatment steps are combined with hydrodesulfurization to greatly reduce the hydrocarbon sulfur content. As noted previously, the oxidation and hydrogenation techniques are effective for converting different types of organic sulfur-containing species, thereby leading to a synergistic effect when these methods are combined. In U.S. Pat. No. 3,505,210, sulfur contaminants in a hydrocarbon fraction are oxidized using hydrogen peroxide or other suitable oxidizing agent to convert bivalent sulfur to sulfones. The hydrocarbon, after having been subjected to oxidation conditions, is then contacted in this case with molten sodium hydroxide to produce a treated product of reduced sulfur content. Another example of a two-step oxidation and extraction method is provided in U.S. Pat. No. 3,551,328, where the extractant is a paraffinic hydrocarbon comprising a 3–6 carbon number alkane. Also, EP-0565324 A1 teaches the effectiveness of oxidizing sulfur-containing compounds followed by removal according to a number of possible separations known in the art.

In contrast to the prior art, applicant has determined that organic sulfur contaminants in petroleum fractions can be first oxidized and then catalytically decomposed to hydrocarbons and volatile sulfur compounds. The hydrocarbons formed by this conversion remain in the treated liquid petroleum fraction as valuable components while the volatile sulfur is easily separable and can therefore be ultimately sent for typical caustic scrubbing and/or sulfur recovery procedures currently practiced commercially. The conversion of oxidized organic sulfur compounds such as sulfones according to the present invention has been determined to occur in the presence of a number of solid catalysts under a wide range of reaction conditions.

Compared to other techniques for the removal of oxidized sulfur compounds from hydrocarbons, heterogeneous catalytic decomposition offers distinct advantages. For instance, in prior art methods for extracting sulfones, liquid extractants are continually consumed due to solution losses and invariable contamination of the treated hydrocarbon product. Also, the high energy costs and incomplete component separations associated with distillative separations, as taught in other disclosures, are avoided using the process of the present invention. Lastly, the frequent replacement of adsorbent beds when hydrocarbons with high sulfur levels are treated is also overcome.

Regarding the oxidative/adsorptive processes of the prior art in particular, U.S. Pat. No. 3,945,914 teaches, as a first step, the oxidation of sulfur compounds in hydrocarbons using any conventional oxidant to form an oxidized sulfur compound. In a second step, the oxidized sulfur-containing hydrocarbon is contacted with a metal to form a metal-sulfur-containing compound. This process therefore relies on the adsorption of oxidized sulfur compounds from the hydrocarbon using a metal capable of forming a metal sulfide. The metal is selected from the group consisting of Ni, Mo, Co, W, Fe, Zn, V, Cu, Mn, Hg, and mixtures thereof. This process is distinguished from conventional hydrodesulfurization in that the sulfur is immobilized in the form of a metallic sulfur compound (e.g. a metal sulfide) rather than converted to hydrogen sulfide. For this reason, the addition of free molecular hydrogen, as is required in hydrodesulfurization, is overcome. A hydrogen atmosphere, however, is apparently needed to effect the reduction of oxidized sulfur to the metal sulfur compound, based on the Examples I–III of this reference.

Adsorptive processes for the removal of oxidized sulfur compounds may provide a higher degree of overall sulfur reduction than traditional hydrodesulfurization processes. However, several disadvantages are associated with this type of treatment including the need for an adsorptive metal component, a hydrogen atmosphere, and high temperatures and pressures to carry out the desired formation of a metal sulfur compound. Furthermore, without frequent regeneration of the metal sulfur compound back to the original, useful form of the metal component, the metal becomes quickly expended by formation of the metal sulfur compound. Otherwise, to avoid numerous regenerations, a large amount of the metal component must be utilized.

To overcome these disadvantages, applicants have found that the oxidized sulfur compounds can instead be conveniently converted, using a catalyst, to volatile sulfur compounds and sulfur-free hydrocarbons. The catalytic conversion takes place under relatively mild conditions without the use of hydrogen atmosphere. Because the sulfur does not remain on the catalyst, but is instead released in a vapor phase, active catalytic sites are not consumed stoichiometrically upon contact with oxidized sulfur species. Furthermore, the need for a metal that is known to be reactive with sulfur, including those used normally in hydrodesulfurization catalysts (e.g. molybenum) and also described in the aforementioned '914 patent, is avoided. In fact, hydrodesulfurization-metal containing catalysts of the prior art are not recommended to carry out the conversion of oxidized sulfur compounds to volatile sulfur compounds, in accordance with the process of the present invention.

SUMMARY OF THE INVENTION

A primary object of the present invention is to provide a process for treating a liquid hydrocarbon feed stream containing an organic sulfur compound, the process comprising the steps of contacting the liquid feed with an oxidizing agent at oxidation conditions, thereby yielding an effluent stream containing an oxidized organic sulfur compound, and; contacting the effluent stream with a solid decomposition catalyst at decomposition conditions effective to decompose the oxidized sulfur-containing compound, thereby yielding a treated liquid stream and a volatile sulfur compound.

In a preferred embodiment the present invention is a process for treating a hydrotreated diesel fuel feed stream containing a thiophene compound or a derivative thereof, the process comprising the steps of contacting the liquid feed with an alkyl hydroperoxide at oxidation conditions, thereby yielding an effluent stream containing a sulfone, and; contacting the effluent stream with a solid decomposition catalyst selected from the group consisting of layered double hydroxides, molecular sieves, inorganic metal oxides, and mixtures thereof at decomposition conditions effective to decompose the oxidized sulfur-containing compound, thereby yielding a treated liquid stream and a volatile sulfur compound.

In another embodiment the present invention is a process as described above, further comprising separating the treated liquid stream from the volatile sulfur compound.

DETAILED DESCRIPTION OF THE INVENTION

The feed to the process of the present invention comprises broadly any liquid hydrocarbon stream contaminated with an organic sulfur-containing compound. More particularly applicable, however, are straight run and cracked oil refinery streams including naphtha, gasoline, diesel fuel, jet fuel, kerosene, and vacuum gas oil. These petroleum distillates invariably contain sulfur compounds, the concentrations of which depend on several factors including the crude oil source, specific gravity of the hydrocarbon fraction, and the nature of upstream processing operations.

The present invention has been found to be particularly effective for converting sterically hindered sulfur compounds such as thiophenes and thiophene derivatives, that are known to be essentially non-reactive in hydrotreating (or hydrodesulfurization) reaction environments. For this reason, the oxidation/decomposition method of the present invention may be practiced either before or after conventional hydrotreating is performed on any of the aforementioned feed stocks to significantly enhance overall sulfur removal efficiency. If hydrotreating is performed first, the liquid hydrocarbon feed stream to the present invention is a hydrotreated naphtha, hydrotreated gasoline, hydrotreated diesel fuel, hydrotreated jet fuel, hydrotreated kerosene, or hydrotreated vacuum gas oil. Alternatively, hydrotreating can also be performed after the oxidation and decomposition steps to yield a high quality sulfur-depleted product.

Specific types of sulfur compounds of utmost concern in the refining industry, due to their refractory nature in otherwise effective hydrotreating environments, include thiophene, benzothiophene, dibenzothiophene and alkylated dibenzothiophenes. Alkylated dibenzothiophenes include the various isomers of methyl-substituted dibenzothiophenes such as 4-methyldibenzothiophene; 2,8-dimethyldibenzothiophene; and 3,7-dimethyldibenzothiophene. Other more complex sulfur-containing structures comprising at least three benzene, thiophene, or saturated rings as described in *Ind. Eng. Chem. Res.* 1991, 30, p. 2022 are also readily converted by the 2-step oxidation/decomposition method of the present invention.

In the first step of the treatment process, the liquid hydrocarbon stream to be treated is contacted with an oxidizing agent at oxidation conditions. Generally, the oxidation is carried out under mild conditions, at a temperature from about 40° C. to about 120° C. and an absolute pressure from about 0.5 to about 15 atmospheres. Suitable oxidizing agents have been found to be alkyl hydroperoxides (e.g. t-butyl hydroperoxide), peroxides (e.g. hydrogen peroxide), percarboxylic acids (e.g. peracetic acid) and oxygen. These compounds generally exhibit sufficient oxidation strength to convert thiophenes in the hydrocarbon feed to sulfones. Furthermore, hydroperoxides, peroxides, percarboxylic acids, and oxygen are desirable as oxidizing agents due to their acceptable solubility in the hydrocarbon feed under oxidation conditions.

In general, the oxidizing agent should be introduced in at least the stoichiometric equivalent quantity of the feed sulfur, and preferably in an amount from about 1 to about 100 moles per mole of sulfur in the liquid feed. Vigorous mixing of the oxidizing agent and liquid hydrocarbon is advantageous in the oxidation step and typically performed using an appropriate means of agitation such as a mechanical stirrer. Alternatively, liquid-liquid contact can also be enhanced with a static mixer. When oxygen gas is used for the oxidation step, a sparger or other type of gas distributor is usually beneficial at the point of injection to achieve sufficient mixing to overcome mass transfer limitations. The oxidation reaction may be carried out batch wise or continuously. For batch operation, a stirred tank reactor is appropriate, while continuous operation typically requires a continuously stirred tank reactor (CSTR). In either batch or continuous operation, a reactor residence time of about 1 to about 48 hours is preferred. In CSTR operation the residence time is understood to mean the average residence time of the reactants in the reactor.

When oxygen is selected as an oxidizing agent, either pure oxygen gas or a mixture of oxygen and a diluent can be employed. Air is often chosen for convenience. With either pure or impure oxygen, it is preferred to carry out the oxidation step of the present invention in conjunction with a solid oxidation catalyst. Without limiting the scope of the present invention, it is believed that a heterogeneous oxidizing catalyst promotes the oxidation (by oxygen) of various species contained in the feed to form hydroperoxides in situ. For example, oxygen can react catalytically with cumene that exists in the feed to form cumene hydroperoxide, which in turn serves as an oxidizing agent for organic sulfur contaminants.

In general, an oxidation catalyst can optionally be used in conjunction with any of the oxidizing agents (not only oxygen gas) described previously, including alkyl hydroperoxides, peroxides, and percarboxylic acids. Suitable solid oxidation catalysts and methods for their preparation are known in the art and include various metals dispersed on inorganic metal oxide supports such as silica, alumina, titania, molecular sieves, and mixtures thereof. Molecular sieves are described in detail in Szostak, *Molecular Sieves, Principles of Synthesis and Identification,* Van Nostrand Reinhold, (1989) at pages 2–4. Catalytic metals that have been found to be most effective in promoting the oxidation step of the present invention include molybdenum, tungsten, chromium, vanadium, niobium, tantalum, titanium, cobalt, and mixtures thereof. Solid oxidation catalysts can be employed in any number of configurations known in the art. Such configurations include fixed-, moving-, fluidized-, and swing-bed systems, among others, although a fixed bed is preferred. For oxidation using a solid catalyst, the preferred weight hourly space velocity (WHSV) is from about 0.1 to about 10 $hr^{-1}$. As understood in the art, the WHSV is the hourly rate of liquid feed weight flow divided by the catalyst weight and represents the reciprocal of the average time that a weight of liquid feed equivalent to the catalyst bed weight is charged to the catalyst.

Regardless of whether the oxidation reaction is performed heterogeneously in the presence of a solid catalyst or homogeneously, the oxidation step converts thiophenes originally present in the liquid hydrocarbon to sulfones. For example, dibenzothiophene is readily oxidized to dibenzothiophene sulfone. Other types of organic sulfur-containing compounds, including branched alkyl sulfides, are oxidized to sulfoxides and sulfones. It is the oxidized form of the organic sulfur species that are amenable to decomposition according to the second step of the method of the present invention.

After oxidation of at least a portion of the organic sulfur compounds in the liquid hydrocarbon feed, the second step of the present invention involves a catalytic decomposition of the oxidized organic sulfur species. As decomposition catalysts, both solid acids and bases have been found to be effective. The characterization of a particular catalyst formulation in terms of its acidic or basic properties is described in detail in Satterfield, Heterogeneous Catalysis in Practice, McGraw-Hill, pp. 151–153 (1980). Acidic catalysts effective for the decomposition step include amorphous aluminosilicates having various proportions of silica and alumina as well as crystalline acidic aluminosilicates such as ZSM-5 and mordenite. Both ZSM-5 and mordenite are described in terms of structure and properties in *Zeolite Molecular Sieves* by Donald W. Breck (John Wiley and Sons, 1974). Acidic catalysts effective for the decomposition of oxidized organic sulfur compounds also include metal oxides, such as alumina, and mixed metal oxides such as $SiO_2.ZrO$.

Metal oxides that exhibit basic properties, for example MgO, have also shown suitability in catalyzing the decomposition of oxidized organic sulfur compounds. Other examples of effective basic catalysts include layered double hydroxides such as hydrotalcite, a magnesium/aluminum layered double hydroxide. The preparation of double hydroxides is well known in the art and described in detail in both *J. Catalysis,* 94, 547–557 (1985) and U.S. Pat. No. 5,318,936; both of which are incorporated by reference. The preparation of hydrotalcite, for example, can be performed by coprecipitation of magnesium and aluminum carbonates at a high pH. Thus magnesium nitrate and aluminum nitrate (in the desired ratios) are added to sodium carbonate. The resultant slurry is heated at about 65° C. to crystallize the hydrotalcite and then the powder is isolated and dried.

Conditions appropriate for the catalytic decomposition of sulfones broadly include a temperature from about 200° C. to about 600° C. and an absolute pressure from about 0.5 to about 20 atmospheres. In contrast to typical hydrodesulfurization or hydrotreating processes, the preferred decomposition conditions of the present invention are significantly more mild and include a temperature from about 350° to about 400° C. and a pressure from about 5 to about 10 atmospheres. Furthermore, a hydrogen, carbon monoxide, or other type of reducing atmosphere is not required. In other words, the decomposition step can take place in a non-reducing environment, meaning that, not considering vapors from the hydrocarbon feed itself, reducing gases such as hydrogen, carbon monoxide, etc are substantially absent. Preferably, the decomposition reaction pressure is maintained by the hydrocarbon pressure alone, without any supply of added overhead or blanketing gas.

Similar to the oxidation step, the decomposition step can be carried out using a fixed-, moving-, fluidized-, or swing bed system, but it is preferred to use a fixed bed of catalyst. In carrying out the decomposition step using a solid catalyst, the effluent hydrocarbon stream from the oxidization step, containing oxidized sulfur compounds is passed continuously through a bed of decomposition catalyst at a WHSV from about 0.1 to about 10 $hr^{-1}$. Any of the aforementioned solid decomposition catalysts and oxidation catalysts (if used) associated with the present invention may be in the form of pellets, spheres, or any other desirable shape.

Generally, catalyst particle size and shape are chosen, as is known in the art, to prevent undue pressure drop across the bed but permit adequate diffusion of reactants to active sites on the catalyst surface or within the catalyst particle.

Under decomposition conditions, the oxidized organic sulfur compounds are converted to sulfur-free hydrocarbons and volatile sulfur components. Without wishing to be bound to any particular theory or reaction mechanism, applicants propose that the catalytic decomposition of oxidized sulfur compounds results in the formation of sulfur dioxide according to the following general reaction pathway:

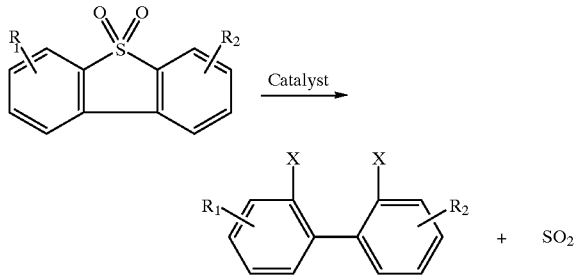

The sulfur-free hydrocarbon, generated from the decomposition, contributes to the yield of the treated liquid product, while the volatile sulfur component is primarily gas phase with a trace amount dissolved in the liquid. For example, consistent with the above explanation, dibenzothiophene sulfone has been shown to decompose to biphenyl (and, to a much lesser extent, hydroxybiphenyl) and sulfur dioxide gas. The aromatic reaction product biphenyl is, in most hydrocarbon products marketed commercially as fuels, considered a valuable clean-burning energy source.

After decomposition of the oxidized sulfur compounds, the treated liquid hydrocarbon product is typically reduced in sulfur content to less than about 60% of the sulfur concentration originally contained in the feed. This level of reduction, of course, depends greatly on the nature of the sulfur compounds initially present. It may be further desirable to separate residual volatile sulfur that is dissolved in the treated liquid stream. Because of the large boiling point disparity between the volatile sulfur and the hydrocarbon components in the treated liquid, a simple flash vaporization at atmospheric or sub-atmospheric pressure or a distillation technique is very effective. These separation techniques are well understood in the art and can in this case be performed at conditions mild enough so as not to degrade or significantly alter the quality of the treated hydrocarbon product.

The following examples are provided to further illustrate and clarify, but not to limit, the present invention.

Comparative Example 1

A sample of hydrotreated diesel fuel was found to contain initially 536 ppm by weight (wt-ppm) of total sulfur, measured based on X-ray fluorescence (XRF) analysis. Of the sulfur present, greater than 90% by weight was in the form of thiophenes such as thiophenes, benzothiophene, and dibenzothiophene. The sample was treated as follows:

The hydrotreated diesel fuel was oxidized at 80° C. and 1 atmosphere absolute pressure using the oxidizing agent t-butylhydroperoxide in the presence of an oxidation catalyst comprising molybdenum on an alumina carrier. The molybdenum was present in an amount representing 12% of the weight of the carrier. The oxidation reaction was carried out in a batch autoclave using mechanical agitation for approximately 24 hours. Thus, this oxidation was in accordance with the first step of the present invention. After the reaction, the hydrocarbon effluent from the oxidation reaction was analyzed and found to contain 567 wt-ppm of total sulfur, again measured by XRF. (The increase in total sulfur content is most likely attributable to the volatilization of some hydrocarbons during oxidation.) A second analysis of this stream, using gas chromatography (GC) equipped with a sulfur-sensitive detector, showed that greater than 97% by weight of this sulfur was in the form of sulfones, demonstrating the effectiveness of the oxidizing agent and solid catalyst system for converting thiophenes to sulfones. The product resulting from this oxidation of hydrotreated diesel fuel was termed the Reference Feed and was used in subsequent experimental work targeting the catalytic removal of the oxidized sulfur species.

After the oxidation step, the Reference Feed was passed over a solid bed of commercial hydrotreating catalyst comprising Ni/Mo on a solid support comprising a zeolite. Reaction of the oxidized sulfur species was attempted at a temperature of 350° C., an absolute pressure of 6.8 atmospheres (100 psi), and a WHSV of 5 $hr^{-1}$. The reaction pressure was maintained using the Reference Feed pressure only, without the use of hydrogen or other pressurizing gas. After having been subjected to these conditions, the reaction effluent was analyzed and the total sulfur level, compared to the original concentration, did not decrease to any measurable extent. Also, the sulfur level of the catalyst itself was high (about 2700 ppm), indicating that some adsorption of sulfur had occurred, which would be expected since the catalyst contained a known sulfur-reactive metal. Aside from this adsorption, however, the hydrotreating catalyst did not prove effective for removing, over an extended run time of 36 hours, the oxidized sulfur species under conditions of low pressure and also in the absence of hydrogen. Furthermore, based on GC-AED (atomic emission detection), about 50% of the sulfone species were converted back to their homologous starting thiophene.

Comparative Example 2

The Reference Feed of Comparative Example 1 was passed over a solid bed of the same catalyst (12% Mo on alumina) used initially to oxidize the hydrotreated diesel fuel. The reaction conditions used to attempt the catalytic removal of the oxidized sulfur species were similar to those described in Comparative Example 1, but using a maximum reaction temperature of 450° C. Again, the reaction effluent showed negligible removal of the oxidized sulfur species, in spite of the fact that some of the sulfur (3000 ppm relative to the catalyst weight) was adsorbed onto the catalyst by the sulfur-reactive metal (i.e. Mo). Furthermore, the sulfur containing compounds in the Reference Feed and the reaction effluent were characterized using GC-AED to determine individual component contributions. From this analysis, it was determined that a substantial portion (>90%) of the oxidized sulfur species (dibenzothiophene sulfone) in the Reference Feed was converted back to the non-oxidized dibenzothiophene, thereby reversing the reaction effected in the oxidation step. Again, this catalyst, which contained a hydrotreating function (i.e. Mo) was not effective for removing, over an extended run time of 48 hours, the oxidized sulfur species under conditions of low pressure and also in the absence of hydrogen, characteristic of the present invention.

EXAMPLE 1

The Reference Feed as described in Comparative Example 1 was passed over a solid bed of catalyst comprising an amorphous acidic aluminosilicate having a silica to alumina ($SiO_2/Al_2O_3$) molar ratio of about 3. Decomposition conditions included a temperature of 475° C., an absolute pressure of 6.8 atmospheres (100 psi), and a WHSV of 5 $hr^{-1}$. After having been subjected to decomposition conditions about 50 hours, the treated diesel fuel was analyzed and the total sulfur level, compared to the original concentration, decreased about 40%, to 339 wt-ppm based on XRF analysis. This finding indicated that the acidic aluminosilicate was an effective catalyst for the reduction of sulfur in the hydrocarbon stream, via the decomposition of sulfones contained therein.

In contrast, the total sulfur level decreased only about 4%, in a similar experiment where glass beads were used as the decomposition catalyst, rather than the acidic aluminosilicate. In this case, the small amount of reduction in sulfur content observed may be attributed mostly, if not totally, to thermal decomposition.

EXAMPLE 2

The experiment described in Example 1 was repeated except that the starting sulfur level in the hydrotreated diesel fuel was 540 wt-ppm. Also, amorphous magnesium oxide, a basic inorganic metal oxide, was used in place of the acidic aluminosilicate as the sulfone decomposition catalyst.

After having been subjected to decomposition conditions to about 50 hours, the treated diesel fuel was analyzed and the total sulfur level, compared to the original concentration, decreased about 74%, to 140 wt-ppm. This finding indicated that the magnesium oxide was an effective catalyst for the reduction of sulfur in the hydrocarbon stream, via the decomposition of sulfones contained therein.

EXAMPLE 3

The experiment described in Example 1 was repeated except that the starting sulfur level in the hydrotreated diesel fuel was 590 wt-ppm. Also, a layered double hydroxide called hydrotalcite was used in place of the acidic aluminosilicate as the sulfone decomposition catalyst.

After having been subjected to decomposition conditions to about 50 hours, the treated diesel fuel was analyzed and the total sulfur level, compared to the original concentration, decreased about 53%, to 270 wt-ppm. This finding indicated that hydrotalcite was an effective catalyst for the reduction of sulfur in the hydrocarbon stream, via the decomposition of sulfones contained therein.

EXAMPLE 4

A sample of vacuum gas oil (VGO) was found to contain initially 2% by weight of total sulfur, measured based on XRF analysis. The VGO was oxidized at 80° C. and 1 atmosphere absolute pressure using the oxidizing agent t-butylhydroperoxide in the presence of an oxidation catalyst comprising molybdenum on an alumina carrier. The molybdenum was present in an amount representing 12% of the weight of the carrier. The oxidation reaction was carried out in a batch autoclave using mechanical agitation for approximately 24 hours. Thus, this oxidation was in accordance with the first step of the present invention.

After the reaction, it was impossible to determine the total sulfur level or extent of oxidation of the sulfur compounds using GC analysis as described in previous examples. This was due to the relatively high boiling point temperature range of the particular feed stock chosen for this example. However, the oxidized vacuum gas oil was diluted with pure toluene to reduce viscosity, to allow the desired analytical measurements. The total sulfur level of the toluene-diluted oxidized VGO was determined to be 6347 ppm based on XRF analysis.

After having been subjected to oxidation conditions and diluted with toluene, the VGO was then passed over a solid bed of catalyst comprising an amorphous magnesium oxide (MgO). Decomposition conditions included a temperature of 425° C., an absolute pressure of 6.8 atmospheres (100 psi), and a WHSV of 1 $hr^{-1}$. After having been subjected to decomposition conditions to about 50 hours, the treated diesel fuel was analyzed and the total sulfur level, compared to the original concentration, decreased about 83%, to 1094 wt-ppm based on XRF analysis. This experiment provides a reasonable basis for concluding that MgO was an effective catalyst for the reduction of sulfur in the VGO stream, via the decomposition of sulfones contained therein.

What is claimed is:

1. A process for treating a hydrocarbon feed stream containing an organic sulfur compound, the process comprising the steps of:

(a) contacting the hydrocarbon feed stream with an oxidizing agent at oxidation conditions, thereby yielding an effluent stream containing an oxidized organic sulfur compound, and;

(b) contacting the effluent stream with a solid decomposition catalyst consisting essentially of a solid acid or base selected from the group consisting of layered double hydroxides, molecular sieves, alumina, silica, zirconia, and mixtures thereof at decomposition conditions effective to decompose the oxidized organic sulfur compound, thereby yielding a treated hydrocarbon stream and a volatile sulfur compound.

2. The process of claim 1 where the liquid hydrocarbon feed stream is a petroleum distillate selected from the group consisting of naphtha, gasoline, diesel fuel, jet fuel, kerosene, vacuum gas oil, and mixtures thereof.

3. The process of claim 1 where the liquid hydrocarbon feed stream is a hydrotreated petroleum distillate selected from the group consisting of hydrotreated naphtha, hydrotreated gasoline, hydrotreated diesel fuel, hydrotreated jet fuel, hydrotreated kerosene, hydrotreated vacuum gas oil, and mixtures thereof.

4. The process of claim 1 where the organic sulfur compound is selected from the group consisting of thiophene, benzothiophene, dibenzothiophene, alkylated dibenzothiophenes, and mixtures thereof.

5. The process of claim 1 where the oxidation conditions include a temperature from about 40° C. to about 120° C. and an absolute pressure from about 0.5 to about 15 atmospheres.

6. The process of claim 1 where the oxidizing agent is selected from the group consisting of alkyl hydroperoxides, peroxides, percarboxylic acids, oxygen, air, and mixtures thereof.

7. The process of claim 1 where the oxidizing agent is present in an amount from about 1 to about 100 moles per mole of the organic sulfur compound.

8. The process of claim 1 where the oxidation conditions include a residence time from about 1 to about 48 hours.

9. The process of claim 1 where the oxidation step is carried out in the presence of an oxidation catalyst comprising a solid carrier having a metal deposited thereon.

10. The process of claim 9 where the solid carrier is a molecular sieve or an inorganic metal oxide.

11. The process of claim 9 where the metal is selected from the group consisting of molybdenum, tungsten, chromium, vanadium, niobium, tantalum, titanium, cobalt, and mixtures thereof.

12. The process of claim 9 where the oxidation conditions include a weight hourly space velocity from about 0.1 to about 10 $hr^{-1}$.

13. The process of claim 1 where the decomposition conditions include a non-reducing environment, a temperature from about 200° C. to about 600° C., an absolute pressure from about 0.5 to about 20 atmospheres, and a weight hourly space velocity from about 0.1 to about 10 $hr^{-1}$.

14. The process of claim 13 where the decomposition conditions include an absolute pressure from about 5 to about 10 atmospheres.

15. The process of claim 13 where the decomposition conditions include a temperature from about 350° C. to about 400° C.

16. The process of claim 1 where the volatile sulfur compound is sulfur dioxide.

17. The process of claim 1 where the treated liquid stream contains less than about 60% of the organic sulfur compound in the liquid feed.

18. The process of claim 1 further comprising, subsequent to step (b), the step of: hydrotreating the treated hydrocarbon stream.

19. The process of claim 1 further comprising, subsequent to step (b), the step of: separating the treated hydrocarbon stream from the volatile sulfur compound.

20. The process of claim 19 where the separation is carried out using flash vaporization or distillation.

* * * * *